US007793470B1

(12) United States Patent
Mathiesen et al.

(10) Patent No.: US 7,793,470 B1
(45) Date of Patent: Sep. 14, 2010

(54) DECK PLANKS

(76) Inventors: John P. Mathiesen, 957 Oakridge Ave., Shoreview, MN (US) 55126; Thomas Kilgriff, 22545 Olinda Trail N., Scandia, MN (US) 55073

( * ) Notice: Subject to any disclaimer, the term of this patent is extended or adjusted under 35 U.S.C. 154(b) by 346 days.

(21) Appl. No.: 11/787,222

(22) Filed: Apr. 13, 2007

Related U.S. Application Data

(63) Continuation-in-part of application No. 11/057,899, filed on Feb. 15, 2005, now abandoned.

(51) Int. Cl.
*E04F 15/00* (2006.01)

(52) U.S. Cl. ..... 52/177; 52/592.2; 404/41

(58) Field of Classification Search ..... 52/177, 52/592.1, 592.2, 592.4, 588.1, 581; 404/41
See application file for complete search history.

(56) References Cited

U.S. PATENT DOCUMENTS 890,436 A * 6/1908 Momberg ..... 52/506.01
3,062,338 A * 11/1962 De Ridder et al. ..... 52/579
3,385,182 A * 5/1968 Harvey ..... 404/35
3,593,468 A * 7/1971 Bustin ..... 52/27
4,099,358 A * 7/1978 Compaan ..... 52/588.1
7,021,012 B2 * 4/2006 Zeng et al. ..... 52/177
7,415,801 B2 * 8/2008 Zeng et al. ..... 52/177
2006/0288651 A1 * 12/2006 Zeng et al. ..... 52/177

FOREIGN PATENT DOCUMENTS

DE 3202385 A1 * 8/1983

* cited by examiner

*Primary Examiner*—Brian E Glessner
*Assistant Examiner*—Adriana Figueroa
(74) *Attorney, Agent, or Firm*—Jacobson and Johnson; Thomas N. Phung

(57) ABSTRACT

A deck plank that can be quickly assembled into a deck with a water resistant seal between adjacent deck planks to inhibit water penetration and an integral drain channel that can direct rainwater away from the deck to provide a protected region below the deck with the deck plank laterally securable to a support to each other to provide a seal therebetween that inhibits the passage of moisture therebetween as well as securement to the support.

16 Claims, 7 Drawing Sheets

DECK PLANKS

CROSS REFERENCE TO RELATED APPLICATIONS

This application is a continuation-in-part of U.S. patent application Ser. No. 11/057,899 filed Feb. 15, 2005 now abandoned.

FIELD OF THE INVENTION

This invention relates generally to deck planks and, more specifically, to deck planks that can be secured to a support to quickly provide a water resistant deck without locking the deck planks to each other.

STATEMENT REGARDING FEDERALLY SPONSORED RESEARCH OR DEVELOPMENT

None

REFERENCE TO A MICROFICHE APPENDIX

None

BACKGROUND OF THE INVENTION

The concept of decks that are assembled from planks of either wood, plastics, or metal are known in the art. Oftentimes the space below the deck as well as the deck provides usable space. When the below deck space in an outdoor deck it is desirable to have the deck water resistant so rainwater or moisture does not leak through the deck and hamper the use of the space under the deck. A number of different types of interlocked metal sections that are formed into a deck are available. Generally, the metal sections form a metal to metal contact with each other to provide a deck. As the metal to metal contact generally allows leakage between the sections one generally needs to apply a sealant between adjacent metal sections. Applying a sealant to the joints not only increases the time and difficulty of assembling a deck but if not properly applied the deck can still allow water to seep through the joint between adjacent metal sections. In still other embodiments the planks are required to be mechanically locked to each other.

In order to inhibit moisture from seeping between the planks one should be able to quickly bring the deck planks into edge to edge sealing engagement with each other without having to lock the planks to each other. In addition if moisture should come through the edge to edge sealing of adjacent deck planks one still should be able direct the moisture away from the underside of the deck planks.

The present invention provides an improved deck plank that a homeowner can use to quickly construct a water resistant deck by hand assembly of a plurality of deck planks that each carry at least one resilient sealing member to enable one to quickly bring adjacent deck planks into a water resistant condition without the need to separately apply a sealant to the joint between adjacent planks and without the need to mechanically lock adjacent planks to each other.

In addition to inhibiting leakage of water between adjacent deck planks at least one or more of the deck planks can contain an integral drain channel that is located below the walking surface of the deck to drain away rain water before it accumulates on the deck. As the drain channel is integral to the deck plank, not only can one quickly form a deck with a water resistant seal between adjacent deck planks but one can simultaneously provide a drain channel to the deck that will carry away rain water on the top surface of the deck without the need to install a separate rain gutter.

SUMMARY OF THE INVENTION

A deck plank for forming a deck with the deck plank having an edge for carrying a water resilient seal on one side and tongue on the opposite edge for forming an unstressed compression seal with the resilient seal carried on an adjacent deck plank to inhibit water from passing through a joint between adjacent planks and a drain channel located on the underside of the deck plank to drain away moisture that might seep past the seal between adjacent planks and a fastening link for securing the deck plank to both a support and to an adjacent deck plank together with a method of securing deck planks in a sealing condition by angle fastening the deck plank to a support.

DESCRIPTION OF THE PREFERRED EMBODIMENT

FIGS. 1-5 show a deck plank with a single seal to inhibit passages of moisture therebetween and FIGS. 6-10A show a deck plank with two seals to inhibit passages of moisture therebetween. In the embodiment of FIGS. 1-5 a drain channel is located below the tongue receiving groove to direct any water away from the underside of the deck in the event that water might seep past the seal during the contraction and expansion of the deck planks in response to outdoor temperature changes. In the embodiment of FIGS. 6-10 a drain channel is formed in a top surface of the deck plank. To avoid the problems of mechanically locking of adjacent deck planks to each other to obtain a seal between planks, which prevents relative motion between adjacent planks, each of the deck planks of FIGS. 1-5 contain a fastening link that permits simultaneously sealing engagement of a deck plank to an adjacent deck plank as well as securement of the deck plank to a support.

Figure 1:
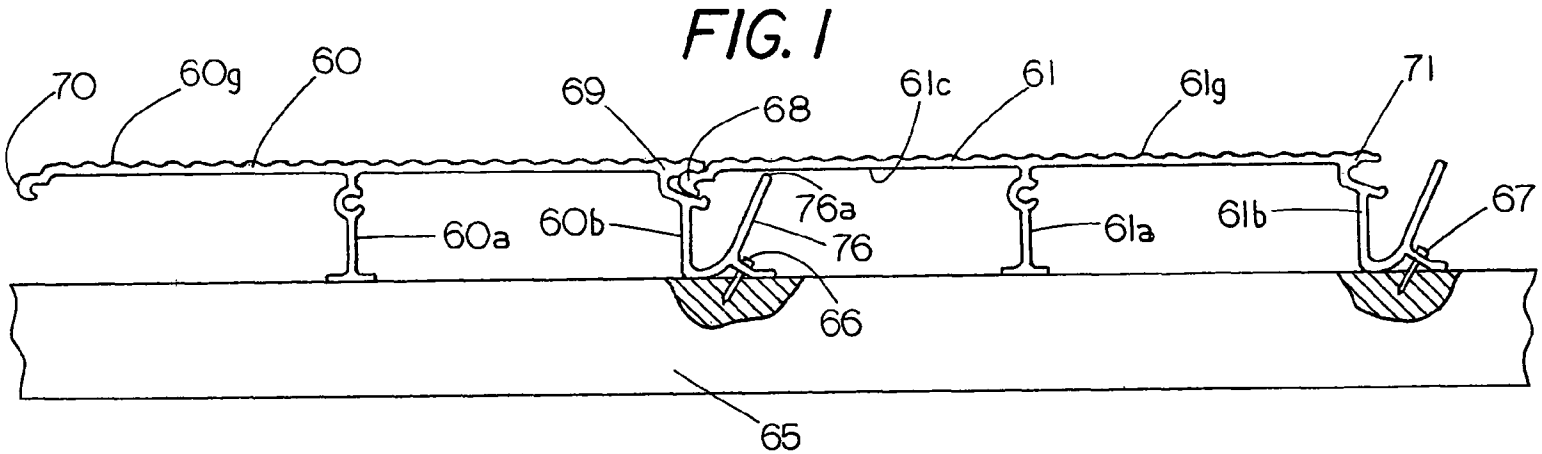
FIG. 1 is an end view of two deck planks in engagement with each other.

A reference to the embodiments of FIGS. 1-5 shows that FIG. 1 discloses an end view of a first deck plank 60 in engagement with an adjacent deck plank 61 to form a portion of a deck. Deck planks 60 and 61, which can be made from aluminum plastic or the like, are identical and are shown connected in an edge-to-edge condition to form a portion of a deck. Deck plank 60 has a panel 60*g* with a top rippled walking surface and deck plank 61 also has a panel 61*g* with a top rippled waking surface. Deck plank 60 includes an intermediate leg 60*a* and an end leg 60*b* that supports deck plank 60 on support 65. Similarly, deck plank 61 includes an intermediate leg 61*a* and an end leg 61*b* that supports deck plank 61 on support 65. A fastener 66, which is extendible through a deck plank 60, secures deck plank 60 to support 65 and a fastener 67, which is extendible through deck plank 61, secures deck plank 61 to support 65. Deck plank 60 includes a tongue 70 on one edge and a bifurcated edge 69 on the opposite edge. Similarly, deck plank 61, which is identical to deck plank 60, includes a tongue 68 on one edge and a bifurcated edge 71 on the opposite side of deck plank 61.

Figure 2:
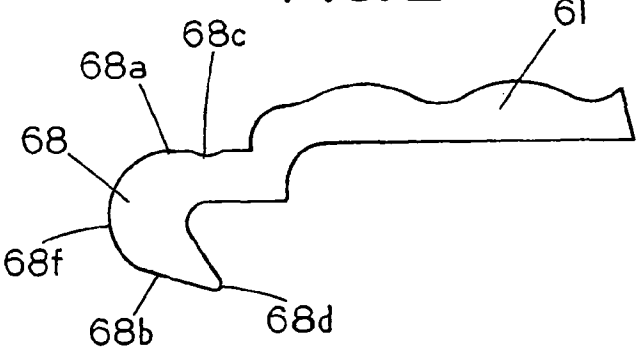
FIG. 2 is an isolated view of the tongue of a deck plank.

FIG. 2 shows an isolated view of the tongue 68 of FIG. 1 showing the tongue 68 includes a rounded end 68*f* having an upper face 68*a* and a lower face 68*b* with a retaining dimple 68*c* located in upper face 68*a*. The bottom portion of tongue 68 includes a retaining lip 68*d*. As tongue 70 is identical to tongue 68 it is not described herein. The tongue 68 includes an upper face 68*a* and a lower face 68*b* for mating to a bifurcated edge on an adjacent plank.

Figure 3:
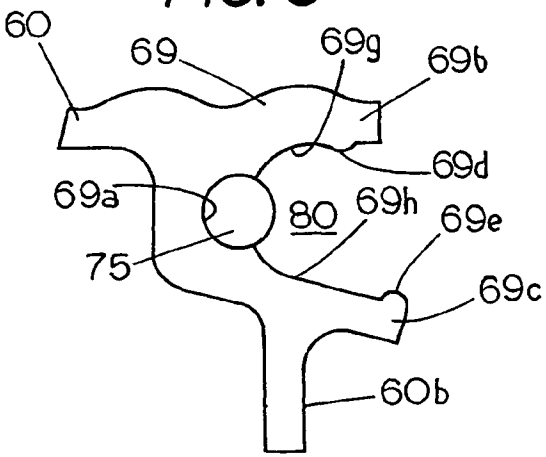
FIG. 3 is an isolated view of the bifurcated edge forming a tongue-receiving groove.

FIG. 3 shows an isolated view of bifurcated edge 69 forming a tongue-receiving groove 80 therein with a resilient sealing member 75 located proximate a cylindrical wall 69*a* forming a partial cylindrical recess. The upper bifurcated edge 69*b* is spaced from the lower bifurcated edge 69*c* and forms a U-shaped opening or groove 80 for receiving a tongue therein. A retaining lip 69*d* extends downward from upper leg 69*b* and a retaining lip 69*e* extends upward from leg 69*c*. The lips coact with a tongue of an adjacent plank to assist in retaining the tongue in the bifurcated edge of the adjacent plank.

Figure 4:
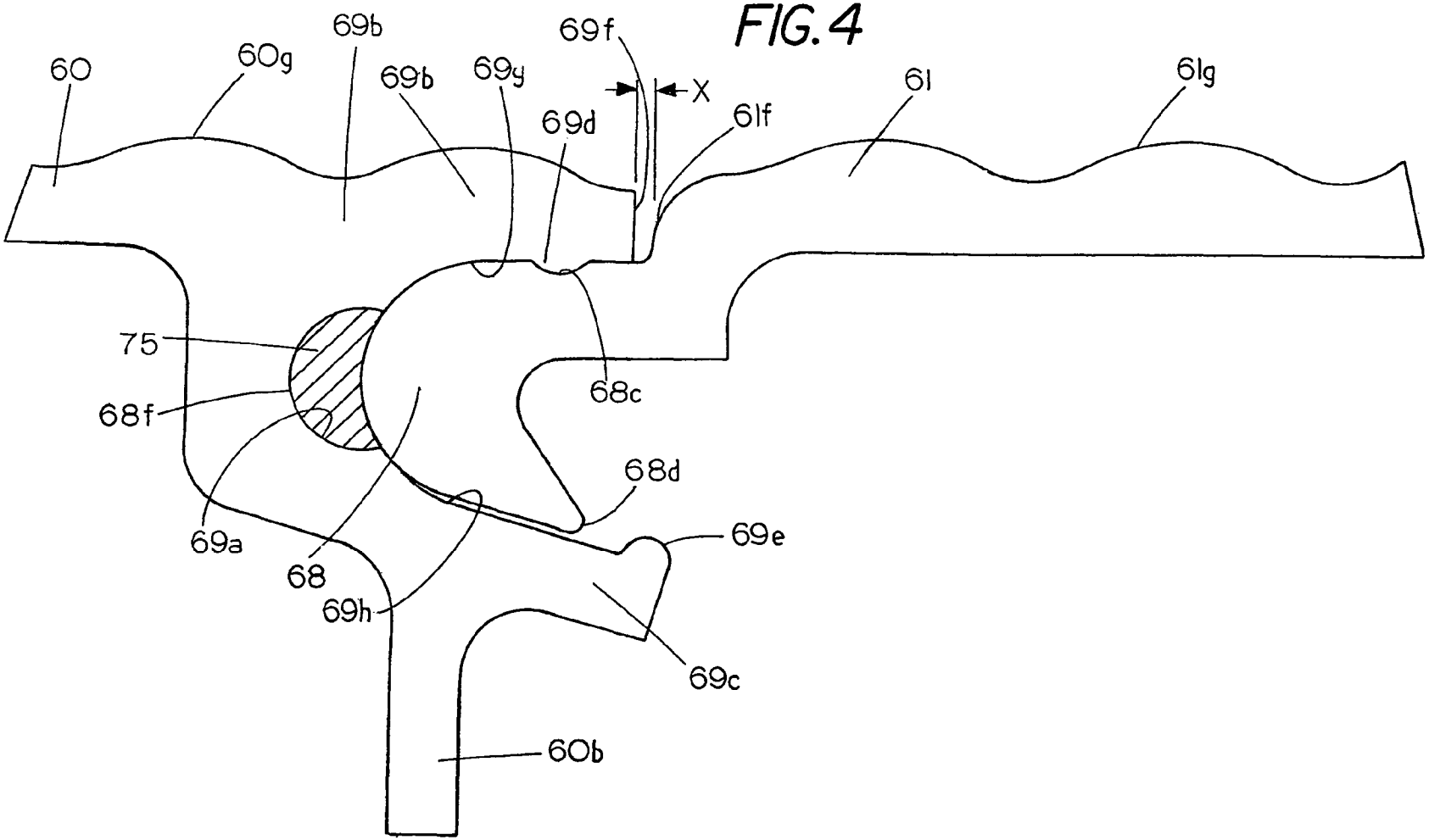
FIG. 4 is an isolated view of the tongue of FIG. 2 in engagement with the bifurcated edge of the tongue-receiving groove of FIG. 3.

FIG. 4 shows an isolated view of the bifurcated edge 69 of deck plank 60 in engagement with the tongue 68 of an adjacent deck plank 61. When deck plank 60 and deck plank 61 are in engagement with each other a normally round resilient seal 75, which can comprise and elastomer or the like, is laterally compressed between the rounded end 68*f* of tongue 68 and the partial cylindrical wall 69*a* to form a compression joint seal, between adjacent deck planks 60 and 61. To assist in retaining the tongue 68 proximate the bifurcated edge 60 there is included a retaining lip 69*d* on bifurcated edge 69*b* in engagement with a retaining dimple 68*c* on the top face of tongue 68. Similarly, a lower lip 68*d* can engage a retaining lip 69*e* to help retain the two adjacent deck planks 60 and 61 proximate each other. Thus, even though the deck planks may flex as weight is placed on top of planks the lip 69*e* and the tip 68*d* ensure that the tongue 68 and the bifurcated edge 69 do not become engaged while the resiliency of seal 75 ensures that the seal can be maintained at the joint between deck plank 60 and deck plank 61 during thermal expansion and contraction of the deck planks. In addition, FIG. 4 shows the compressible engagement of the seal 75 occurs with a rounded end or face 68*f* of tongue 68 thus avoiding sharp edge contact that can produce a stressed seal that can cause seal breakdown.

FIG. 4 also shows that when the deck planks are mated to each other a vertical edge face 69*f* of plank 60 and a vertical edge face 61*f* of plank 61 are spaced slightly from each other. This ensures that normal production variations in the formation of the deck plank will not interfere with the in field engagement of the tongue 68 with the bifurcated edge 69 since it eliminates having to simultaneously match two different sections of the planks. Thus one needs to match only the face 68*a* and 68*b* of tongue 68 with the internal surface faces 69*g* and 69*h* of the bifurcated edge 69. FIG. 4 illustrates that the surface face 69*h* diverges from surface face 69*g* thus facilitating the field alignment of the tongue 68 with the bifurcated edge 69.

Figure 5:
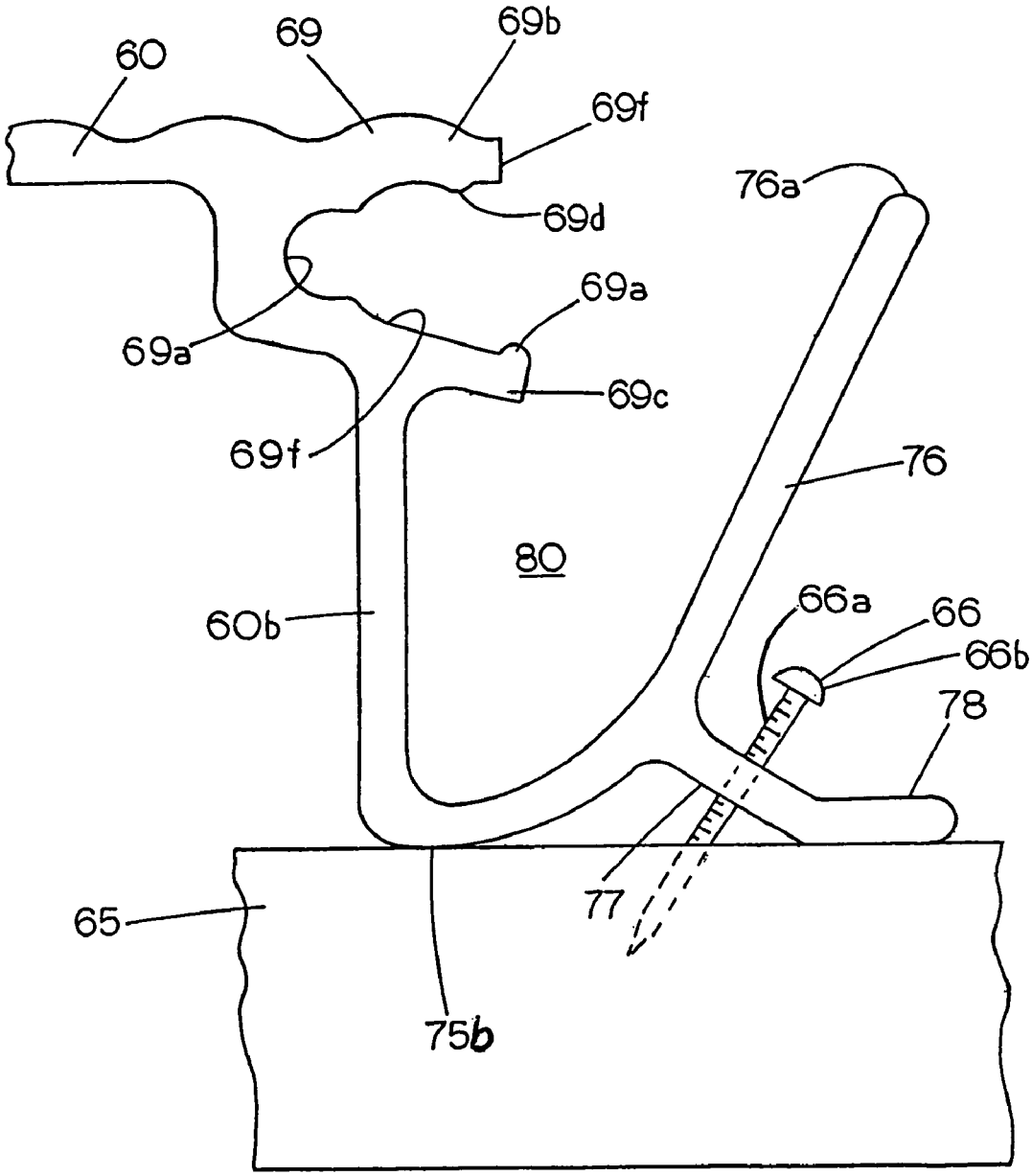
FIG. 5 is an isolated view of drain channel and support leg of a deck plank.

FIG. 5 shows and isolated view of the bifurcated edge 69 being supported by a leg 60*b* having a base 75*b* and an upward extending member 76 to form an integral drain channel 80 therein. Member 76 includes a top end 76*a* wherein the top end 76*a* of extending member 76 is spaced from an underside 61*a* of a panel 61*g* when the deck plank 60 and an adjacent deck plank 61 are in engagement with each other. Thus when assembled with adjacent deck plank provides a slight clearance between the underside 61*c* of deck plank 61 to allow for flexing without the deck planks squeaking as they rub against one another. Extending outward from member 76 is an angled fastening link 77 that includes a fastener 66 positioned at an acute angle to the support 65 to allow the fastener 66 to be extendible through fastening link 77 and into angle in support 65. A foot 78 connects to fastening link 77 and coacts with the base 75*b* to vertically support the bifurcated edge 69. By placing the fastener in the angled fastening link 77 as opposed to in the foot, which is parallel to the support 65, one can use the fastening force to laterally displace the deck plank. In the embodiment shown fastener 66 comprises a self tapping screw having a head 66*b* and a spiral thread 66*a* that can be extended through the fastening link 77 by use of a power screw driver or the like. By inserting the fastener 66 at an angle to the support 65 one can laterally draw the deck plank 60 toward an adjacent deck plank as well as vertically secure the deck plank 60 to the support 65. While a self tapping fastener is disclosed other angle fasteners including nails or the like can be used to laterally displace the deck plank and secure the deck plank to the support. As can be seen another benefit of the angle fastening is that it allows one to simultaneously secure the deck plank to the support as well as bring a deck plank into sealing engagement with the adjacent deck plank without having to first lock each of the deck planks to each other before securing the deck plank to a support.

Thus the deck plank 60 and the deck plank 61 each contain a panel having a first edge having a tongue and an opposite bifurcated edge having a tongue-receiving groove for receiving a sealing member; a leg having a base for supporting said bifurcated edge with the leg having an upward extending member to form a drain channel; and a link for laterally displacing said deck plank into sealing engagement with an adjacent deck plank when a fastener is extended therethrough.

In the embodiment of FIGS. 1-5 the method of assembly of deck planks to form a deck includes the steps of securing a first deck plank 60 having a bifurcated edge to a support 65; placing a sealing member 75 in the first deck plank; extending a tongue 68 of a second deck plank into the sealing member 75; and laterally displacing the second deck 61 plank into the first deck plank 60 by angle fastening the second deck plank 61 to the support by inserting a fastener such as a self tapping screw through a link of second deck plank 61 and into the support 65. The method can further include the step of supporting the bifurcated end 69 with a leg 60*b* forming a portion of a drain channel and locking the tongue 68 of the second deck plank 61 to the bifurcated leg 69 of the first plank 60 through retaining members on the tongue and the bifurcated edge.

Figure 6:
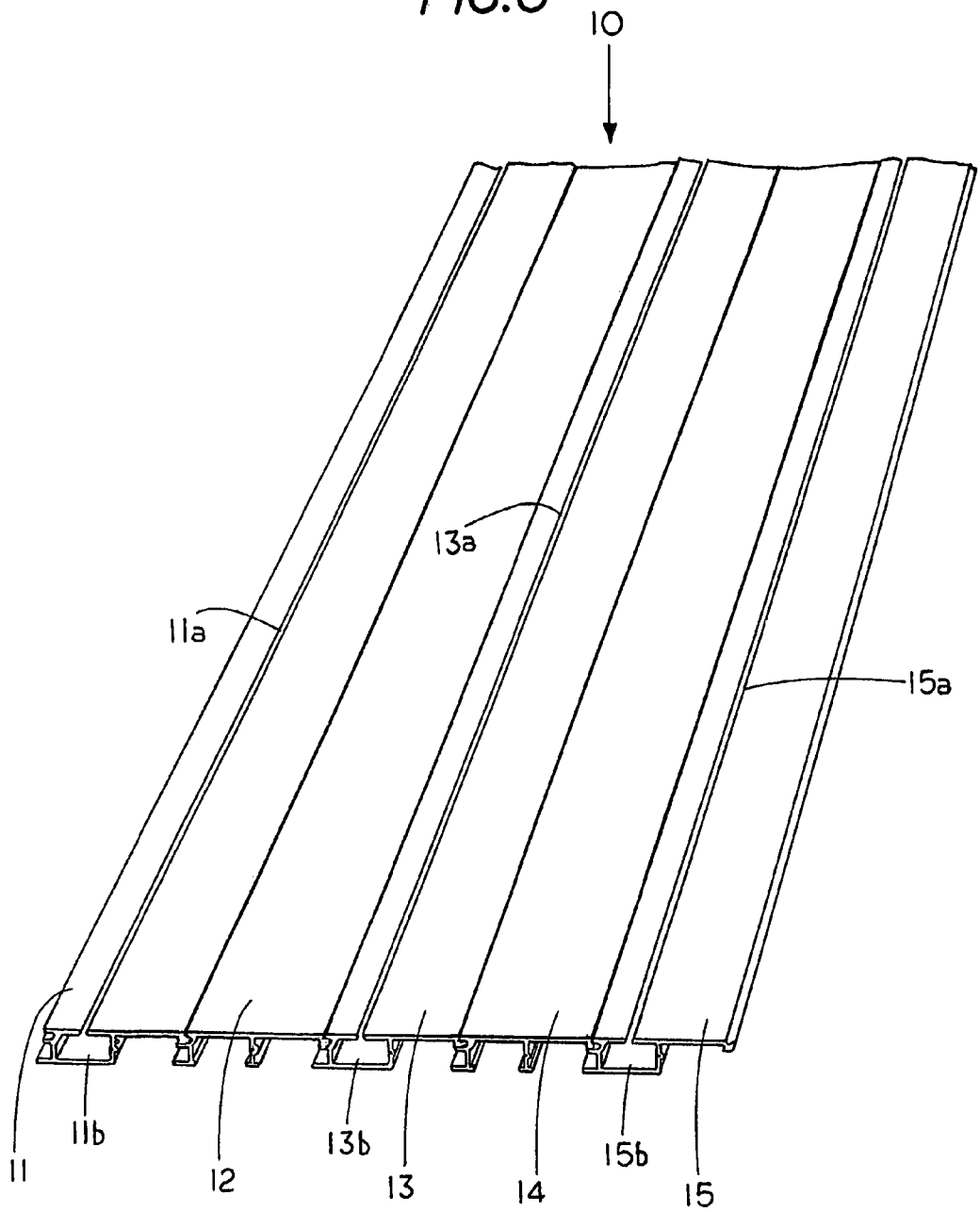
FIG. 6 is perspective view of a deck formed from the deck planks of the present invention.

FIG. 6 shows a perspective view of a deck comprised of a plurality of deck planks 11, 12, 13, 14 and 15 that are interconnected to an adjacent plank by a tongue and groove arrangement. While five deck planks are shown assembled more or less deck planks can be assembled to enable the user to build a water resistant deck to accommodate the users needs. In the deck 10 two types of deck planks are shown, deck planks 11, 13 and 15 with an integral drain channel and the deck planks 12 and 14 without an integral drain channel. That is, deck plank 11 has an integral elongated drain channel 11*b* that extends the length of the plank 11 with an elongated water inlet 11*a* that also extends the length of the deck plank 11. Similarly, deck plank 13 includes an elongated integral drain channel 13*b* that extends the length of plank 13 and an elongated water inlet 13*a* that extends the length of plank 13. Likewise, deck plank 15 includes an integral drain channel 15*b* that extends the length of plank 15 and an elongated water inlet 15*a* that also extends the length of plank 15. By having the drain channels extend the length of the plank it enables one to cut the deck planks to the proper length and be assured that whatever length the plank is cut to it will still include and integral drain channel that will discharge water out the ends of the deck planks and thus shield persons or items below the deck from rainwater falling on top of the deck. The deck planks are preferably made of metal such as aluminum and can be provided with a textured covering such as urethane to provide a weather resistant walking surface on the plank.

In the embodiment shown a set of deck planks with no integral drain is shown in locked and sealed engagement with deck planks that contain integral drains. For example, deck planks 12 and 14 have no integral drain channel but can still be interconnected with those deck planks 11, 13 and 15 that do have integral drain channels. If desired each of the deck planks in the deck 10 could have integral drain channels or only the end planks could include integral drain channels. An advantage of the present invention is that the user can build the deck to the desired drain channel configuration since the deck planks with the integral drain channels can be interchanged with those deck planks that do not have integral drain channels. For example, a portion of a deck may be under a cover or an overhang and not require drain channels to direct rainwater away from the top surface of the deck.

Figure 7:
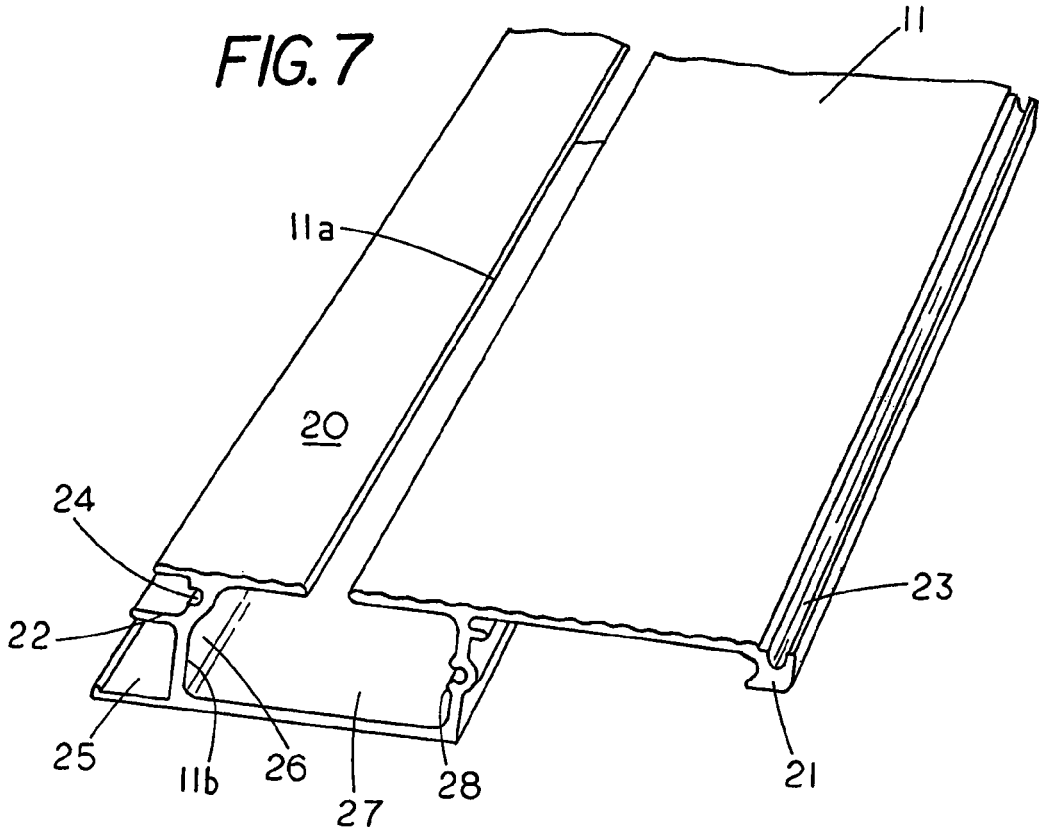
FIG. 7 is perspective of a deck plank of the present invention with an integral drain channel.

FIG. 7 shows a perspective view of a portion of deck plank 11 that illustrates the elongated water inlet 11*a* that extends the length of plank 11 and the integral drain channel 11*b* that also forms a support or integral leg for the deck plank 11 to enable the deck plank to be mounted on a support member. Deck plank 11 includes a top walking surface 20 and on one side of plank 11, a tongue 21 and on the opposite side of plank 11 a tongue channel 22. Tongue 21 carries an upward extending seal channel 23 for receiving and retaining a resilient sealing member therein during handling and assembly of the deck plank to an adjacent deck plank and tongue channel 22 carries a laterally facing seal channel 24 therein for receiving an retaining a resilient sealing member therein during handling and assembly of the deck plank to an adjacent deck plank. Each of seal channels 23 and 24 not only receive and retain the resilient water resistant sealing member in the unassembled condition but can compressively held the water resistant seals between a tongue on one plank and a tongue channel on an adjacent plank to provide a series of two seals that form a weather resistant joint between adjacent planks. That is, the use of two seals in series in the joint between adjacent deck planks provides a tortuous path that blocks or inhibits rainwater from passing therethrough.

The integral below deck drain channel 11*b* comprises a first leg 26 and a second leg 28 that are connected to each other by a web 27 to form the integral drain channel with an elongated top opening 11*a*. A fastening flange 25 extends laterally of leg 26 to allow one to secure the deck plank 11 to a support member by the use of fasteners such as screws, nails or the like that can be extended through the flange 25 and into a support member. Thus, the deck plank not only provides an under deck escape path for rainwater that falls on top of the deck but provides a flange on the leg to facilitate support for the deck plank as well as securing the deck plank to a deck support.

Figure 8:
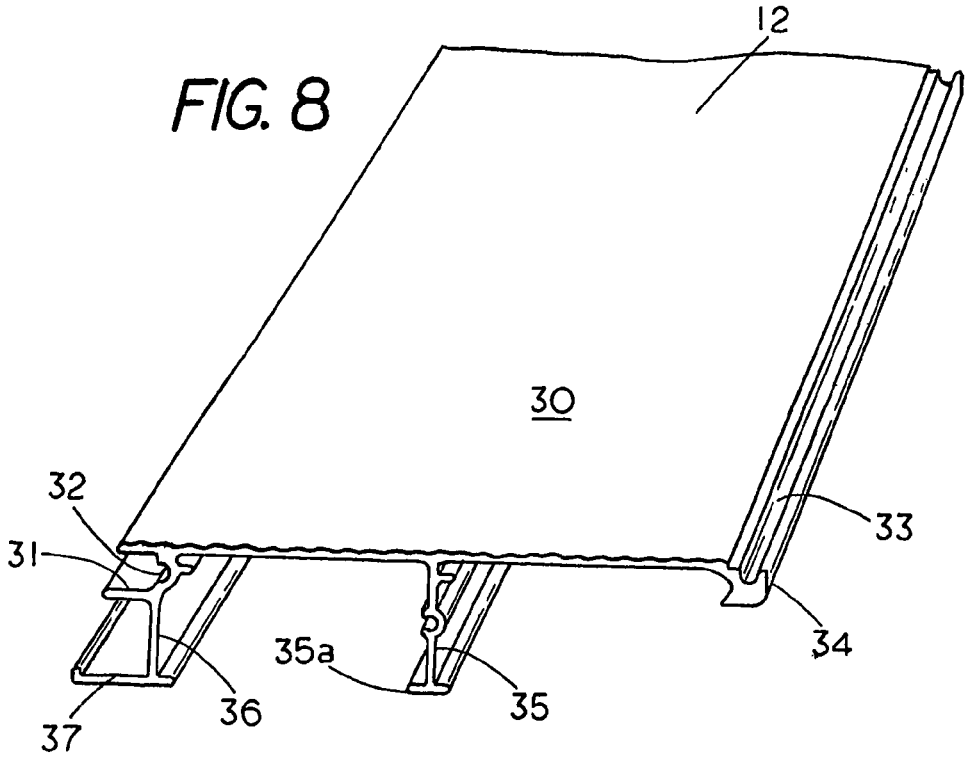
FIG. 8 is a perspective view of a deck plank of the present invention without an integral drain channel.

FIG. 8 shows a perspective view of deck plank 12 which does not contain an integral drain channel. Deck plank 12 includes a tongue 34 extending along one side with a seal channel 33 therein and a tongue channel 31 on the opposite side with a laterally facing seal channel 32 therein. The tongue 34 and tongue channel 33 are identical to the tongue channel and seal channel of deck plank 11 and enable one to interconnect deck planks 11 and 12 in a side by side condition. Vertical support for deck plank 12 is provided by a first leg 35 and a second leg 36 that extend substantially perpendicular to top surface 30. Extending from leg 36 is a flange 37 that not only distributes weight on the plank 12 but allows one to secure the deck plank to a support by the use of fasteners such as screws, nails or the like that can be extended through the flange 37 and into a support member below the deck plank. Similarly, leg 35 contains a foot 35*a* to distribute and support the center of deck plank 12. The portion of deck 30 to the right of leg 35 cantilevers outward and thus contains no leg. However, as described herein after the cantilevered portion of deck plank 12 is supported by a leg of an adjacent plank thereby ensuring that each of the deck planks receive support at both the edges and the center of the plank. A further advantage is that one is assured that the edge of adjacent planks and the sealing relationship therebetween receive a common support to help ensure that the sealing condition is maintained between adjacent planks. The top surface or walking surface 30 of deck plank 12 is covered with a material such as texture urethane which can be obtained as a powder coating and then applied to the deck planks. While deck plank 11 and deck plank 12 contain identical locking edges the top surface of deck plank 12 contains no water inlet to let water pass through the deck plank 12 as does plank 11. Similarly, the underside of deck plank 12 contains no integral drain channel to channel water away as does deck plank 11.

Figure 9:
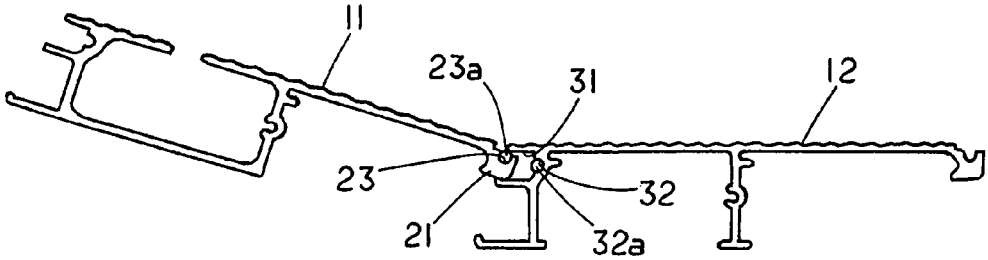
FIG. 9 is an end view of two deck planks that illustrates a step in the engagement of deck planks in a locked side by side relationship.

To illustrate the assembly of the deck planks 11 and 12 in a side by side water resistant condition reference should be made to FIG. 9. FIG. 9 illustrates that the tongue 21 of deck plank 11 is inserted at an acute angle into the tongue channel 31 of deck plank 12. The seal channel 23 carries a resilient water resistant seal 23*a* and likewise the seal channel 32 on plank 12 carries a resilient water resistant seal 32*a*. A suitable water resistant seal comprises a resilient material such as a close cell elongated neoprene and having a cylindrical shape member that has a size slight larger than the cylindrical shaped seal channel so that the resiliently seal 23*a* must be slightly compressed when inserted into the seal channel 23 to thereby hold the resilient seal in position during the handling and joining of adjacent deck planks to each other as the tongue and the tongue channel are snapped into locking engagement with each other.

Figure 9A:
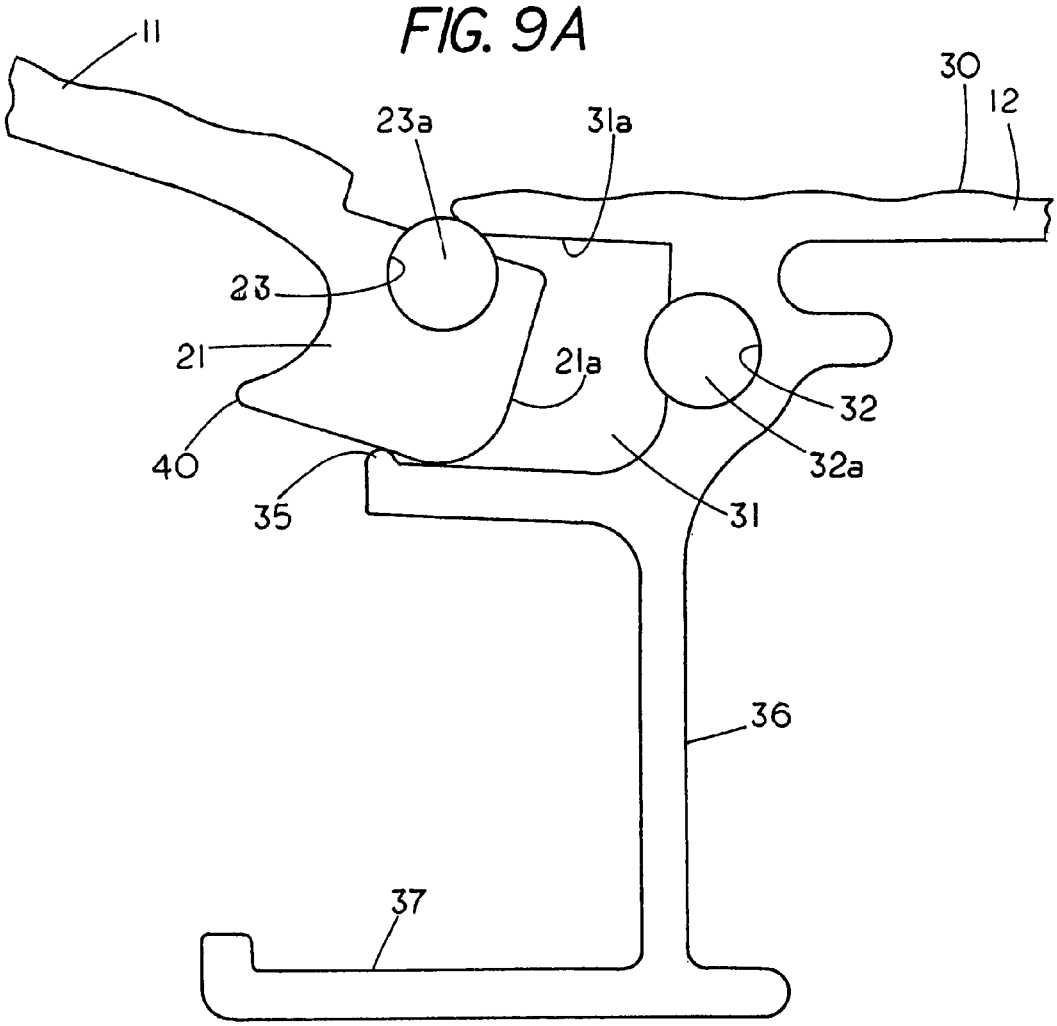
FIG. 9A is an enlarged end view of the tongue and tongue channel of FIG. 9 as the tongue and tongue channel of adjacent deck planks are being brought into a water resistant seal.

FIG. 9A shows an end view of the tongue 21 and tongue channel 31 as the adjacent deck planks 11 and 12 are brought into side-by-side locking engagement with each other. That is the tongue 21 and deck plank 11 are first tipped at an angle so that the underside of tongue 21 can clear a locking lip 35 on channel 31. Note, the resilient seal 23*a* and 32*a* are in a relaxed condition and uncompressed condition, however as seal channel substantially compressively encompasses over half of the water resistant resilient seal the seals 23*a* and 32*a* are held in position for the assembly process.

Figure 10:
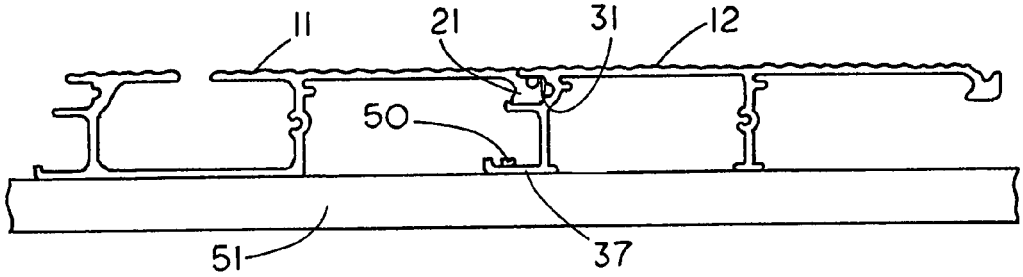
FIG. 10 shows an end view of the planks of FIG. 9 in the assembled condition.
Figure 10A:
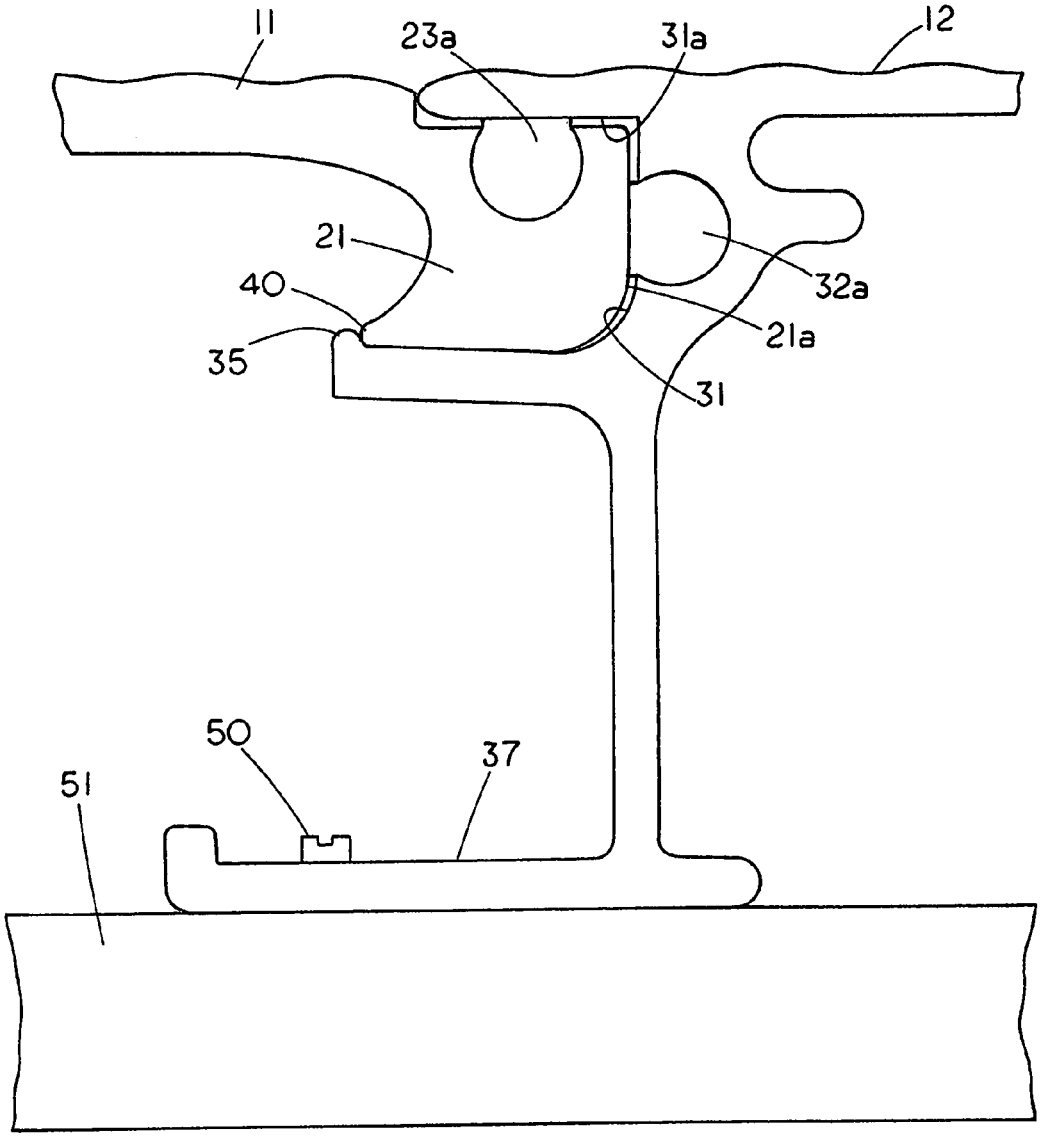
FIG. 10A shows an enlarged end view of the tongue and tongue channel of FIG. 9 with the resilient seals forming a water resistant seal between the adjacent deck planks.

FIG. 10 illustrates the deck plank 12 had been rotated into locking engagement with deck plank 11 and that the flange 37 is secured to support member 51 by a screw 50. To illustrate the detail of the locking and sealing engagement between adjacent deck planks reference should be made to FIG. 10A which shows an enlarged view of the tongue 21 and the tongue channel 31 in locked engagement with each other. In the locked and sealed condition the locking edge 40 on tongue 21 engages the locking lip 35 on channel 31. This prevents lateral withdrawal of plank 11 with respect to plank 12. In this condition the resilient seal 23*a* is compressed against sealing surface 31*a* on the underside of plank 12 to provide a first water resistant seal therebetween. Similarly, the resilient seal 32*a* is compressed against sealing surface 21*a* on the end of tongue 21 to provide a second water resistant seal therebetween with the resilient seals being in series to further inhibit water from passing through the intersection between adjacent planks. The tongue 21 is held in position by locking lip 35 that prevents lateral withdrawal of tongue 21 as well as maintain the resilient seals in the water resistant condition. Thus, the combination of the insertion of the tongue into the channel at an angle and then rotating the tongue creates two elongated sealing regions one having a horizontal orientation and the other a vertical orientation. In addition the tongue 21 and tongue channel 31 of adjacent deck planks mechanically locks the tongue of one deck plank to the tongue channel of the adjacent plank to maintain the structural integrity of the deck while at the same time providing a water resistant seal between adjacent deck planks.

Thus the invention includes the method of making a deck that inhibits or prevents passage of water therethrough while directing surface water away from the deck comprising; by placing a deck plank having a tongue channel on one edge on a support member; inserting a tongue on a further deck plank having an integral drain channel into the tongue channel and rotating the deck plank until the tongue on the further deck plank extends into locking and sealing engagement with the deck plank with the integral drain channel extending along the further deck plank to channel rainwater away from a conjoined top surface of said deck plank and said further deck plank.

The method wherein the step of extending of the tongue on the further deck plank into locking engagement comprises bring a locking edge on the tongue into engagement with a stop on the tongue channel and the step of extending of the tongue on the further deck into sealing engagement comprises squeezing a sealing member located in a sealing channel of the tongue against a sealing surface on the deck plank.

The method also includes the positioning of deck planks on a set of support members with a set or legs on each of the deck plank and the further deck plank supporting the deck plank and the further deck plank in horizontal condition to provide a top treading surface wherein the deck plank and the further deck plank are brought into a conjoined relationship by laterally extending the tongue on the further deck plank into the tongue channel while rotating the tongue of further deck plank in the tongue channel of the deck plank to bring the deck plank and the further deck plank into locked and sealed condition with respect to each other.

We claim:

1. A deck plank assembly comprising:

an edge having a tongue with an upper face and a lower face;

a bifurcated edge forming a tongue-receiving groove therein and a recess extending from the tongue-receiving groove for receiving a sealing member;

a panel extending between said edge and said bifurcated edge;

a leg having a base for supporting said bifurcated edge with said leg having an upward extending member to form a drain channel, said upward extending member spaced from an adjacent deck plank in an assembled condition to allow for flexing of said planks without squeaking caused by the rubbing of said deck planks;

an angled fastening link extending from said upward extending member, said angled fastening link adapted to be positioned at an acute angle with respect to a support; and an angled fastener extending through said fastening link for laterally displacing said deck plank to bring said tongue into sealing engagement with an adjacent deck plank when said angled fastener engages a support.

2. The deck plank of claim 1 including a resilient sealing member located in said recess and the tongue includes a rounded face for compression sealing therewith.

3. The deck plank of claim 2 wherein the upper face of said tongue includes a dimple therein.

4. The deck plank of claim 3 wherein the bifurcated edge includes a retaining lip mateable with said dimple of said tongue to assist in retaining said tongue proximate said bifurcated edge.

5. The deck plank of claim 4 including a foot connected to said link.

6. The deck plank of claim 5 wherein the fastener is a self-tapping fastener.

7. The deck plank of claim 6 wherein the bifurcated edge includes a lower retaining lip for engaging a retaining lip of said tongue to retain said tongue in said bifurcated edge.

8. The deck plank of claim 7 wherein an edge face of bifurcated edge and an edge face of the plank are spaced from each other when the deck plank and the adjacent deck plank are in engagement with each other.

9. A deck plank comprising:

a panel having a first edge having a tongue with an upper face and a lower face and an opposite bifurcated edge having a tongue-receiving groove containing a recess extending from the tongue-receiving groove for receiving a sealing member;

a dimple located on said upper face of said tongue;

a retaining lip extending from said bifurcated edge, said retaining lip mateable with said dimple of said tongue to assist in retaining said tongue proximate said bifurcated edge;

a leg having a base for supporting said bifurcated edge with said leg having an upward extending member to form a drain channel, said upward extending member spaced from an adjacent deck plank in an assembled condition to allow for flexing of said planks without squeaking caused by the rubbing of said deck planks; and a fastening link extending from said upward extending member and adapted to be positioned at an acute angle with respect to a support, said fastening link laterally displacing said deck plank into sealing engagement with an adjacent deck plank.

10. The deck plank of claim 9 including a resilient seal.

11. The deck plank of claim 9 including a fastener angled mounted in said link.

12. The deck plank of claim 9 wherein the drain channel is located below said tongue receiving groove.

13. The deck plank of claim 9 wherein the deck plank includes a foot with the link extending at an angle from the foot.

14. A method of assembly of deck planks to form a deck comprising:

securing a first deck plank having a bifurcated edge to a support;

placing a sealing member in a recess extending from a tongue-receiving groove of the first deck plank;

supporting the bifurcated edge with a leg forming a portion of a drain channel;

extending a tongue of a second deck plank into the sealing member; and laterally displacing the second deck plank into the first deck plank while maintaining an upward extending member of the leg in a spaced condition from the second deck plank by extending a fastener at an acute angle into a fastening link extending from the second deck plank with the fastening link positioned at an acute angle with respect to the support.

15. The method of claim 14 wherein the step of angle fastening comprise inserting a self tapping screw through a fastening link of the second deck plank and into the support.

16. The method of claim 14 including retaining the tongue of the second deck plank to the bifurcated edge of the first plank with a retaining lip.

* * * * *